US006978561B1

(12) United States Patent
Hunter

(10) Patent No.: US 6,978,561 B1
(45) Date of Patent: Dec. 27, 2005

(54) BUBBLE GREETING CARD

(76) Inventor: David Gavin Hunter, 18 Cedar Ave., Towson, MD (US) 21286

( * ) Notice: Subject to any disclaimer, the term of this patent is extended or adjusted under 35 U.S.C. 154(b) by 0 days.

(21) Appl. No.: 11/106,810

(22) Filed: Apr. 15, 2005

Related U.S. Application Data

(63) Continuation of application No. 10/689,255, filed on Oct. 20, 2003, now abandoned.

(51) Int. Cl.[7] ..... G09F 1/04
(52) U.S. Cl. ..... 40/124.01; 40/124.03
(58) Field of Search ..... 40/124.01, 124.03, 40/124.06, 427; 206/459.1, 461

(56) References Cited

U.S. PATENT DOCUMENTS 3,235,988 A 2/1966 Paige
3,494,322 A 2/1970 Dubbels
4,378,391 A 3/1983 Allen
4,911,671 A 3/1990 Rogers
5,261,703 A 11/1993 Lenkoff
5,484,318 A 1/1996 Mayert
6,230,425 B1 5/2001 Ellison
6,348,248 B1 2/2002 Randolph

*Primary Examiner*—Cassandra Davis

(57) ABSTRACT

An improved greeting card is presented that incorporates cellular bubble material, such as bubble wrap, into the images and or text thereon. The bubbles of the cellular bubble material may be popped, thereby providing an amusing and pleasurable activity for the recipient of the card. By making reference to the popping activity, the message on the card may be reinforced. The cellular bubble material provides pleasing visual and tactile features, and if used in quantity provides integral protection of the card and its contents.

8 Claims, 3 Drawing Sheets

BUBBLE GREETING CARD

CROSS-REFERENCE TO RELATED APPLICATIONS

This is a continuation of application Ser. No. 10/689,255, Filed Oct. 20, 2003, now abandoned.

FEDERALLY SPONSORED RESEARCH

Not Applicable

SEQUENCE LISTING OR PROGRAM

Not Applicable

BACKGROUND OF THE INVENTION—FIELD OF THE INVENTION

This invention relates to greeting cards.

BACKGROUND OF THE INVENTION

Greeting cards serve to convey a sentiment from the sender of the card to the recipient. Further, greeting cards provide gratification to the sender when they feel that the sentiment they wish to express has been conveyed effectively.

A multitude of types of greetings card have been produced incorporating features intended to satisfy these functions. Generally cards incorporate: space in which the sender may write a message to the recipient, and preprinted messages and or pictures. The overall design of the card, the pictures, and the preprinted message are formulated so as to appeal to the sender and to the recipient.

Common techniques used to generate appeal include: a pleasing appearance to the card, decorative features, amusing pictures, amusing and or sincere preprinted messages.

Some cards employ additional measures to further their appeal. A "pop-up" art card is taught by U.S. Pat. No. 3,235,988 issued to Richard E. Paige (1966). The three dimensional nature of the images adds novelty to the cards but the novelty generally short lived and the pop-up features are susceptible to damage.

Some cards seek to improve appeal by incorporating features to provide an activity to the recipient. A card incorporating a puzzle message is proposed by U.S. Pat. No. 5,261,703 issued to Roger J. Lenkoff (1992). While some recipients might enjoy completing such a puzzle other people do not enjoy puzzles or may not solve the puzzle thereby failing to receive the complete message from the sender.

Other cards incorporate a small gift such as a stained glass ornament proposed by U.S. Pat. No. 6,230,425 issued to Sandra K. Ellison (2001). Incorporating a gift often adds considerable cost, potentially many times the cost of the card alone.

Prior art of other fields teaches the popping of bubbles in material such as bubble wrap as an activity.

U.S. Pat. No. 4,378,391 issued to Michael L. Allen (1983), proposes an advertising novelty in the form of a napkin that employs the activity of popping strips of bubbles to focus attention on an advertising message.

U.S. Pat. No. 5,484,318 issued to Todd M. Mayert and Curtis Mayert (1996), and U.S. Pat. No. 4,911,671 issued to Buddy L. Rodgers (1990), use the activity of popping bubbles to relieve stress.

U.S. Pat. No. 6,348,248 issued to Christine Randolph (2002), teaches a party favor incorporating bubble wrap type material to make a popping noise.

Although employing bubble wrap type material, this prior art does not attempt to address the objectives of greeting cards. Further, this prior art fails to anticipate the improvements that are achieved in the field of greeting cards by the current invention.

U.S. Pat. No. 3,494,322 issued to Richard P. Dubbels (1970), describes a Pill Dispensing Means that utilizes push out bubbles to contain and dispense pills. Dubbels describes receptacles for pills that have a plastic front and aluminum back and are mounted over holes such that the pills can be pushed out through the aluminum back of the receptacle. This push out bubble structure is suitable for dispensing pills but does not burst by rupturing abruptly when the push out bubble is squeezed, instead the aluminum back is gradually distended and split by the pill being pressed against it. This prior art does not anticipate the improvements to the field of greeting cards that are achieved by the current invention.

OBJECTS AND ADVANTAGES

Cellular bubble material that contains burstable bubbles, such as bubble wrap, is incorporated into the construction of a greeting card as an element of the drawings, images and or text. Popping the cells of cellular bubble material such as bubble wrap is found by many people to be a compelling activity. By incorporating cellular bubble material into the construction of a greeting card this invention enhances the novelty of the drawings, images and or text of the card and provides an amusing and relaxing activity for the card's recipient. The pleasure and amusement that the recipient receives from popping the cells of the cellular bubble material is effectively a gift from the sender that increases the appeal of the card. The recipient will feel thought of, in that the sender selected a card that provides pleasure and amusement beyond the written message.

Many kinds of drawings and images can be enhanced by incorporation of the cellular bubble material. A single bubble can serve as a wart on the end of a witch's nose. A plurality of bubbles can be incorporated as bubbles in a glass of champagne. Bubbles can be incorporated into the flames on the candles of a birthday cake. Bubbles be incorporated into drawings or images as Easter eggs, ornaments on a Christmas tree, lumps on a dinosaur's skin, stars in the sky, balloons, eyeballs, spots on the skin of an animal or a person, or as the dots in a polka dot pattern on clothing, to cite but a few examples. The bubbles can also be incorporated into the construction of the letters of the message as the dot on the letter "i" and as the circular portion of round letters like "o" and "p". There are a multitude of possibilities for the incorporation of the bubbles into drawings, images and text.

The activity of popping the bubbles of the cellular bubble material can be incorporated into the message of many types of cards as an integral element of the message. Consider for example: "Thought I'd just pop this in the mail.", "Why don't you pop by? I miss you.", "I hope you get your pop back soon", (i.e. get well soon). . . . The combination of the message and the popping function provides a basis for development of many witty, amusing and memorable messages, well beyond the few examples shown here.

The popping activity of cellular bubble material of this invention reinforces and more effectively conveys the sentiment of the sender. A "get well" card for example generally expresses the thought that the sender wants the recipient to feel better, and the pleasure of popping the bubbles contributes positively to that message. A card intended to be humorous reinforces that message by providing the amusement of the bubble popping activity and the bubbles can be incorporated into the drawings, images and or text on the card in a manner that makes the popping of the bubbles an integral element of the humor of the card.

As greeting cards are commonly disposed of not long after being received, it is beneficial for a greeting card to be of low cost. Since cellular bubble material such as bubble wrap is a low cost material its incorporation into a greeting card provides the benefits identified while enabling the greeting card to be produced inexpensively.

By being affixed in sufficient quantity to substantially cover a surface of the card the cellular bubble material serves to protect the card from damage due to handling or from being mailed and will it protect an item placed inside the card. This feature avoids the need for a protective envelope since the card can be mailed in a regular envelope.

The cellular bubble material may be transparent, translucent or opaque, and colored as warranted to achieve a suitable effect for the drawing, image or text that it is an element of.

SUMMARY

In accordance with the present invention this greeting card comprises a folded planar card stock to which is adhered a cellular bubble material as an integral element of the drawings, images or text on the card.

DRAWINGS—FIGURES

DRAWINGS—REFERENCE NUMERALS

Figure 1A:
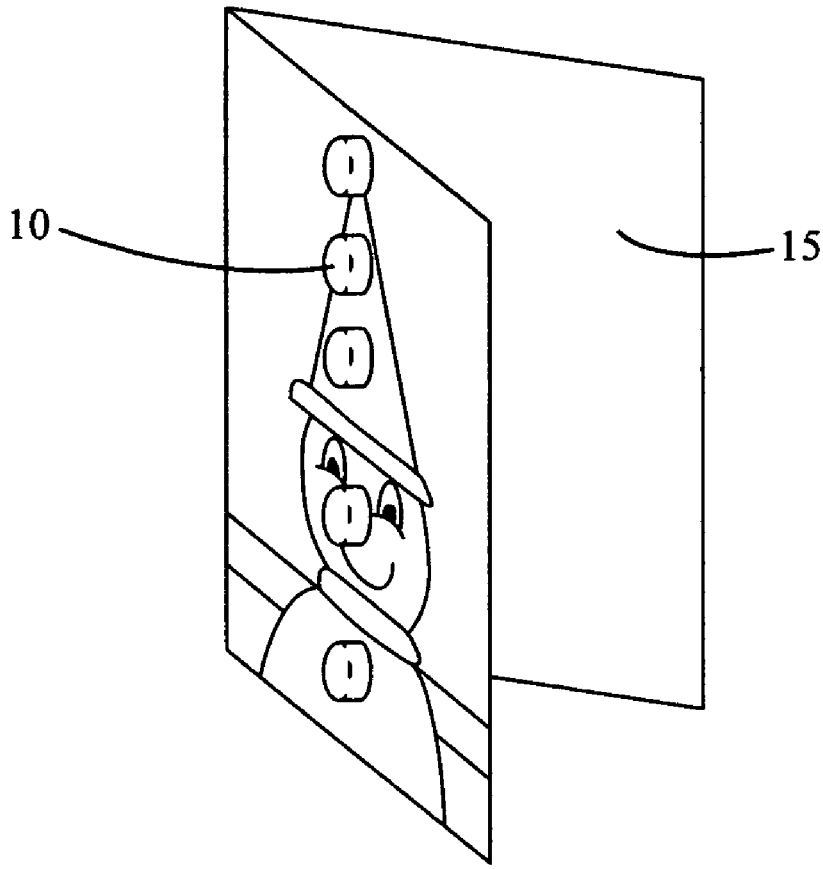
FIG. 1A shows a two-panel greeting card with cellular bubble material incorporated into a drawing on the outer surface.

10 cellular bubble material
15 card stock
20 top bubble layer of cellular bubble material
25 bottom flat layer of cellular bubble material
30 front surface cutouts
35 top card stock layer

DETAILED DESCRIPTION

FIG. 1—Preferred Embodiment

A preferred embodiment of the present invention is illustrated in FIG. 1A (perspective view). The greeting card is comprised of a substantially flat piece of paper or card stock 15 folded so as to form two panels. Cellular bubble material 10 is adhered to the outer surface of the panels in selected locations so as to form an integral element of the drawing on the card. In the preferred embodiment both the outer and inner surface of the panels may have text and or pictures on them. In order to form a suitable element of the image, drawing or text on the card the cellular bubble material may be opaque or where it is desirable that the underlying drawing, image, color or text is visible through the material the cellular bubble material may be clear or translucent.

Figure 1B:
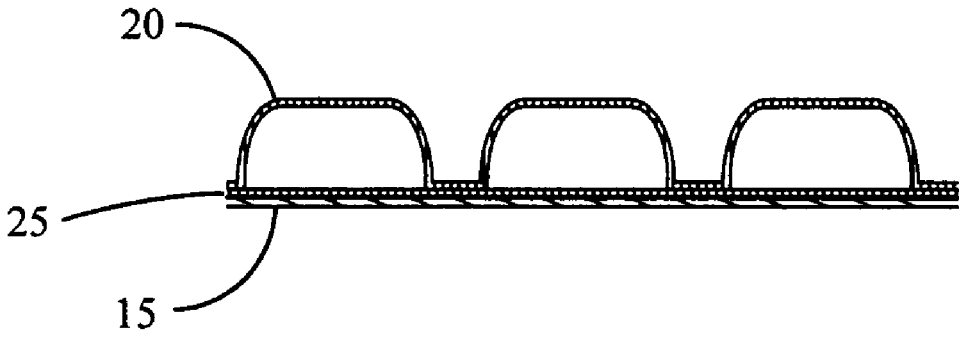
FIG. 1B shows the layers of material of a panel of the card.

The layered structure of the preferred embodiment of the greeting card is illustrated in FIG. 1B (cross-section). The outer bubble layer 20 of the cellular bubble material is affixed to the inner flat layer 25 of the cellular bubble material thereby trapping gas within the bubbles. The card stock 15 is affixed to the bottom of the inner flat layer of the cellular bubble material. A result of this structure is that when one of the bubbles is squeezed it compresses against the card stock and will burst due to increased pressure in the entrapped gas, by abruptly rupturing one of the cellular bubble material layers. This results in a popping effect. A preferred material for the layers of the cellular bubble material is plastic sheet. It is gas impermeable and will rupture abruptly under increased pressure in the entrapped gas.

Figure 2A:
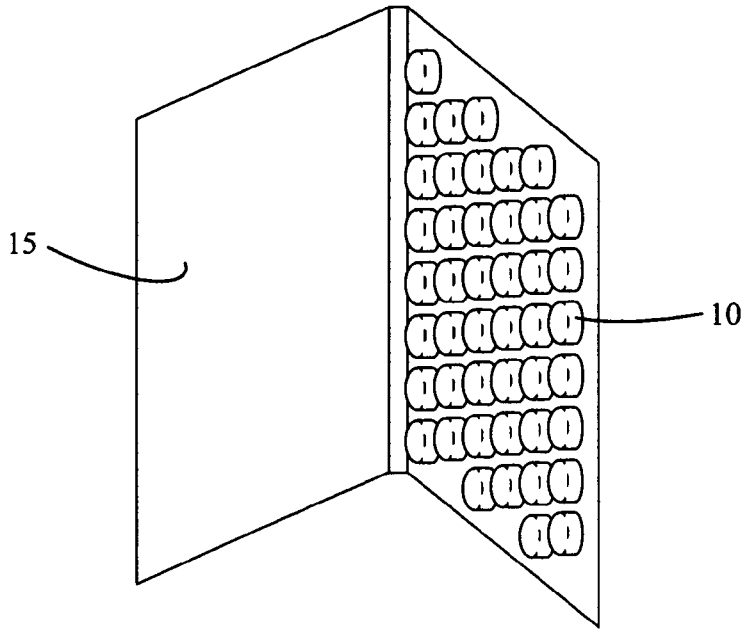
FIG. 2A shows a greeting card with cellular material affixed as a feature of a drawing on the inner surface of the card.
Figure 2B:
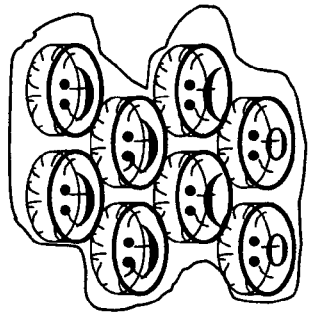
FIG. 2B shows a detailed view of the cellular bubble material with an example text drawing pattern as could be employed in the card shown in FIG. 2A.
Figure 3:
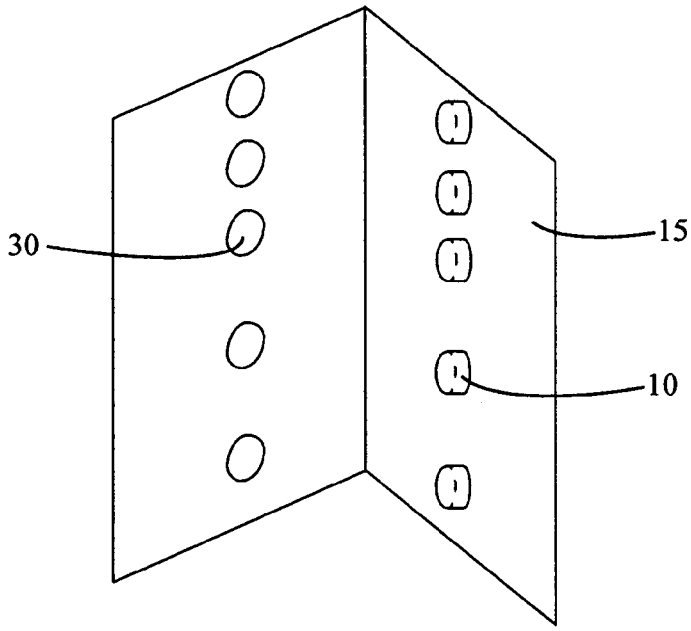
FIG. 3 shows a two-panel greeting card with cellular material affixed to an inner surface of the rear panel located so as to protrude through cut out shapes in the front panel of the card.

FIGS. 2–3—Additional Embodiments

Additional embodiments are shown in FIGS. 2, and 3. In FIG. 2A (perspective view) the cellular bubble material affixed to an inner surface of the card. Two folds are made in the card stock such that when the card is closed the section of card between the folds provides enough separation between the front and back panels to accommodate the thickness of the cellular bubble material that is affixed to the inner surface. The detailed view of the cellular bubble material, text and drawing pattern shown in FIG. 2B (perspective view) illustrates a combination that can substantially cover the surface of a card.

In FIG. 3 (perspective view) the cellular bubble material is adhered to a portion of the inner surface of the rear panel of the card and the front panel has cutouts 30 of similar shapes situated so as to allow the cellular bubble material to protrude through the front panel when the card is closed.

Figure 4:
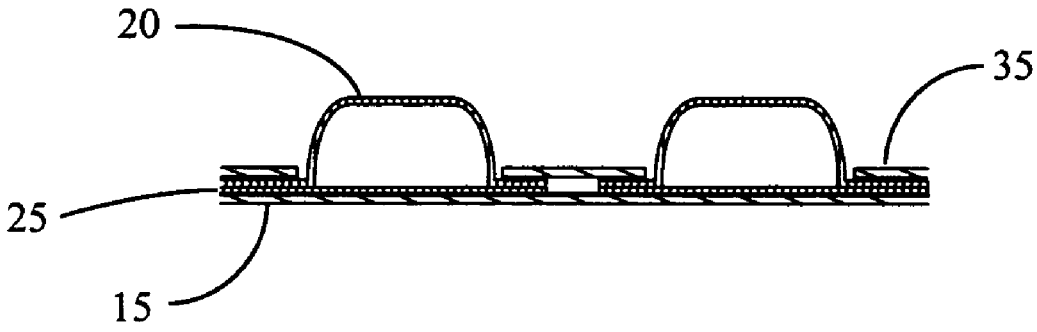
FIG. 4 shows an alternative layer structure for a panel of a card

FIG. 4—Alternative Structure

FIG. 4 (cross-section) illustrates how the cellular bubble material (comprised of the outer bubble layer 20 and the inner layer 25) may be sandwiched between two layers of card stock (15 and 35). The top card stock layer 35 has holes in it of a size and placement that enable it to fit over the cellular bubble material such that the bubbles protrude through the holes. In this manner the top card stock layer 35 can cover the edges and border of the cellular bubble material and can conceal any gaps between pieces of cellular bubble material. Further the top card stock layer 35 serves to hold the cellular bubble material in place. During manufacture of the greeting card the top card stock layer 35 can additionally assist in alignment of the cellular bubble material to the drawings, images and or text on the card.

CONCLUSIONS RAMIFICATIONS AND SCOPE

Thus the reader will see that the current invention provides a highly appealing yet economical greeting card. This greeting card has many advantages: it serves to incorporate novel three dimensional features into the drawings, images and or text of the card, it provides the recipient with an enjoyable activity, the activity and the bubble features that provide the activity reinforce the intended message of the card, this makes the card seem more like a gift to the recipient, it enables the sentiment of the sender to be more effectively conveyed, it is composed of inexpensive materials, and when the cellular bubble material covers a substantial portion of the surface of the card it provides integral protection of the card and its contents against damage.

Although the description above has many specificities, these should not be construed as limitations on the scope of the invention, but rather as an exemplification of some of the currently preferred embodiments of this invention. For example the card can have shapes other than the rectangular forms illustrated. The number of panels and how they are folded can be varied. The panels can be formed of independent pieces of material that are attached along one or more edges. The greeting card can be adorned with any different colors, images, and text messages. The size and shapes of areas of the card that are covered by the cellular bubble material can vary widely. The number of bubbles can range from one to many covering a single area of the card up to the entirety of the surface. The bubbles of the cellular bubble material can be formed in many different shapes, and sizes.

Thus the scope of the invention should be determined by the appended claims and their legal equivalents, rather than by the examples given.

I claim:

1. A greeting card comprising:

a) folded substantially planar stock, said folded substantially planar stock having exterior surfaces and interior surfaces, wherein said interior surfaces are those that are covered as a result of said substantially planar stock being folded, and b) indicia selected from the group consisting of drawings and images and text, and c) cellular bubble material, containing burstable gas filled bubbles, that is affixed to one or more of said exterior surfaces of said substantially planar stock as an integral feature of said indicia.

2. The greeting card of claim 1 wherein said cellular bubble material is comprised of plastic sheets bonded together to form one or more of said burstable gas filled bubbles.

3. A greeting card comprising:

a) folded substantially planar stock, said folded substantially planar stock having exterior surfaces and interior surfaces, wherein said interior surfaces are those that are covered as a result of said substantially planar stock being folded, and b) indicia selected from the group consisting of drawings and images and text, and c) cellular bubble material, containing burstable gas filled bubbles, that is affixed to said substantially planar stock as an integral feature of said indicia, wherein said substantially planar stock incorporates a pair of parallel folds separated by a distance corresponding substantially to one or two times the depth of the cellular bubble material, and said cellular bubble material is affixed to one or more of said interior surfaces of said folded substantially planar stock outside said pair of parallel folds.

4. The greeting card of claim 3 wherein said cellular bubble material is comprised of plastic sheets bonded together to form one or more of said burstable gas filled bubbles.

5. A greeting card comprising:

d) folded substantially planar stock, said folded substantially planar stock having exterior surfaces and interior surfaces, wherein said interior surfaces are those that are covered as a result of said substantially planar stock being folded, and e) indicia selected from the group consisting of drawings and images and text, and f) cellular bubble material, comprised of plastic sheets bonded together to form one or more burstable gas filled bubbles, that is affixed to said substantially planar stock as an integral feature of said indicia.

6. The greeting card of claim 5 wherein said cellular bubble material is affixed to one or more of said interior surfaces of said substantially planar stock.

7. The greeting card of claim 6 wherein there is one or more openings in said substantially planar stock that are shaped and situated such that when the greeting card is folded closed, said burstable gas filled bubbles fit into said openings.

8. The greeting card of claim 5, wherein additional substantially planar stock is affixed over the cellular bubble material, there being one or more openings in said additional substantially planar stock that are situated and shaped such that said burstable gas filled bubbles protrude through the openings.

* * * * *